United States Patent [19]

Carl

[11] Patent Number: 4,495,744

[45] Date of Patent: Jan. 29, 1985

[54] DISPLACEMENT BODY

[76] Inventor: Heinz Carl, Waldstrasse 16, D-8644 Pressig, Fed. Rep. of Germany

[21] Appl. No.: 376,605

[22] Filed: May 10, 1982

[30] Foreign Application Priority Data

May 18, 1981 [DE] Fed. Rep. of Germany ..... 3119703
May 18, 1981 [DE] Fed. Rep. of Germany ..... 3119704
May 18, 1981 [DE] Fed. Rep. of Germany ..... 3119705
Jul. 23, 1981 [DE] Fed. Rep. of Germany ..... 3129165

[51] Int. Cl.[3] ..... E04C 1/06

[52] U.S. Cl. ..... 52/576; 52/577; 52/381; 428/256

[58] Field of Search ..... 52/577, 576, 381, 382, 52/329, 339; 249/134, 135, 183, 203

[56] References Cited

U.S. PATENT DOCUMENTS 3,113,402 12/1963 Butler .
3,224,725 12/1965 Matteson .
4,416,928 11/1983 Carl ..... 52/63

FOREIGN PATENT DOCUMENTS 1745422 5/1957 Fed. Rep. of Germany .
1850167 2/1962 Fed. Rep. of Germany .
1233561 2/1967 Fed. Rep. of Germany .
1274330 8/1968 Fed. Rep. of Germany ..... 52/577
323383 7/1975 Fed. Rep. of Germany .
2503132 7/1975 Fed. Rep. of Germany .
2536731 3/1976 Fed. Rep. of Germany .
2631707 2/1977 Fed. Rep. of Germany .
835937 1/1939 France ..... 52/577
519218 3/1940 United Kingdom ..... 52/577

*Primary Examiner*—Carl D. Friedman
*Attorney, Agent, or Firm*—James E. Nilles

[57] ABSTRACT

Described in a displacement body for forming cavities in concrete structures. The displacement body lends itself to simple and cost-effective production, is extremely light-weight and still capable of meeting stability requirements. In a preferred embodiment the displacement body consists of a grid structure (1) formed of intersecting longitudinal and transverse rods, and plastic sheets (2*a*, 2*b*) applied to both sides of the grid structure and connected to one another and to the grid structure by welding and/or heat-shrinking. Further described are structures formed under employ of such displacement bodies, as well as advantageous methods for making same.

15 Claims, 17 Drawing Figures

DISPLACEMENT BODY

BACKGROUND

This invention relates to a displacement body of the type for forming cavities in concrete structures in the shape of at least one hollow section, said displacement body comprising a wall determining the contours of said cavities, to a structure formed with employ of such displacement body, and to a method for making a displacement body.

Displacement or filler bodies of widely varying materials are generally used for forming concrete structures with cavities. Widely employed for instance are displacement bodies made of lightweight concrete, fired clay, compressed wood fiber material, plastic extrusions or foamed plastics. Each one of these materials has at least one disadvantage, however; it may be too expensive, too fragile for withstanding rough handling at a building site, too complicated to manufacture, too heavy or not stable enough for certain purposes.

Known from DE-OS No. 26 31 707 is a displacement body assembled of extruded sections of a thermoplastic resin by means of connecting pieces. The interior of the hollow body has to be provided with reinforcing struts for achieving the required strength. In addition, engagement profiles are formed along the outer longitudinal edges of the sections for engagement with the connecting pieces. Displacement bodies of this type are of rather involved construction and thus correspondingly expensive to make. The employ of these displacement in making concrete structures or the like requires additional time and labour for connecting individual profiles to each other by means of the connecting pieces.

Concrete structures having cavities formed with the aid of hollow bodies are known for instance from DE-OS No. 25 36 731. In these structures the displacement bodies consist of approximately cubic injection-molded plastic bodies disposed in spaced arrangement with their open sides facing downwards.

A further disadvantage of this type of plastic displacement bodies is that the costs of the finished structure are unnecessarily increased, as they have to be made rather thick-walled or provided with reinforcing struts for stability reasons. The manufacture of these displacement bodies is moreover restricted to specialized manufacturers equipped for this purpose.

From DE-OS No. 25 03 132 it is also known to reinforce shuttering panels by spot-welding construction steel mats to their side facing away from the concrete to be poured. This permits the thickness of the shuttering panels to be considerably reduced without sacrificing any of their strength, so that they may be made of thin metal sheets. Displacement bodies of this construction are not known, however.

SUMMARY OF THE PRESENT INVENTION

It is an object of the invention to provide a displacement body of the type indicated above, which can be made in a simple manner at low costs and is capable of meeting applicable stability requirements in spite of very low weight.

The displacement body consisting of the grid structure and flexible sheet can be manufactured at low costs, in a short time and in any required shape. It is of lightweight construction still offering sufficient stability. A further advantage is the possibility of nesting the displacement bodies in stacks for transport and storage.

The flexible sheets applied to both sides of the flat grid structure in accordance with the invention may be connected to one another and/or to the grid structure in a simple manner without having to be fixed beforehand, so as to enclose the grid structure therebetween.

This results in an effective protection against corrosion being achieved also in the interior of the hollow section in the case of the grid structure material being susceptible to corrosion.

A further improvement of the stability may be achieved by the employ of a construction steel mat.

With the exception of shuttering linings for producing contoured surfaces, plastic materials have hitherto scarcely been used in the building industry. It is considered as being not sufficiently tear-resistant and too extensible under load. It has been unexpectedly found, however, that the employ of a plastic sheet as disclosed herein results in a displacement body fully capable of supporting the weight of the concrete poured thereon. The displacement body covered with the tensioned plastic sheet is therefore extremely light-weight, cost-effective and weather-resistant. It can be produced anywhere, at low expense and in any desired numbers.

The employ of a shrinkable sheet according to the invention permits the sheet to be tensioned over the grid structure in a simple manner.

The employ of a readily destructible sheet in accordance with the invention, for instance of a combustible or meltable plastic sheet, permits the sheet to be easily removed from a cavity which is to be filled with concrete or the like later on.

The sheet-free base portion improves the fixation of the displacement body in the surrounding concrete and permits a continuous concrete plate to be formed below the cavity.

The specification specifies a displacement body for simultaneously forming several cavities without the additional preparatory steps required in prior art. The sheet-free connecting portions are imbedded in the concrete, resulting in reliable fixation. At the same time the connecting portions serve as spacers between the hollow sections.

The specification describes a particularly advantageous embodiment for forming ribbed concrete structures.

The substantially vertically upstanding edge portions according to the specification may be embedded in concrete so as to contribute to the fixation of the displacement body, or may serve as a joint reinforcement.

The substantially closed displacement body can be manufactured in a particularly simple and cost-effective manner.

The specification describes a further advantageous embodiment of a displacement body. The closure members permit the end portions of the displacement body to be closed off without requiring additional welding operations.

A structure according to the invention can be made rapidly and cost-effectively by the employ of the displacement body consisting of a grid structure and a flexible sheet. The displacement body has sufficient stability and is still of very low weight, so that the weight of the finished structure is not noticably increased.

According to the invention, the sheet-free base portion of the displacement body is connected to the reinforcement of the building structure, whereby the expenditure for finishing the building structure may be further reduced.

The employ of a displacement body comprising several hollow sections connected to one another by connecting portions in accordance with the invention is conductive to uncomplicated and rapid finishing operations, as the connecting portions are effective both as spacers between the hollow sections and as fixation means.

The substantially vertically upstanding edge portions serve to further improve the fixation or may be utilized as joint reinforcements.

The vertically upstanding edge portions of the reinforcement mat according to the invention serve as joint reinforcement. In a ceiling constructed of individual structures in accordance with the invention, the upstanding edge portions are suitably bridged by U-shaped brackets.

The disclosure described a particularly advantageous method for making a displacement body.

The disclosure describes advantageous variations of the production method. Depending on transport facilities, the building location or the desired size and shape of the displacement body, any of these variations may be preferred.

The attachment of the plastic sheet may be carried out in a simple manner by the application of heat in accordance with the invention.

The disclosure describes further possibilities of attaching the sheet, which may be selected in accordance with requirements in any particular case.

Embodiments of the invention shall now be described in detail with reference to the accompanying drawings, wherein:

FIG. 1 shows a perspective view of a displacement body according to the invention comprising a transparent sheet cover, FIG. 2 shows a cross-sectional view of a channel-shaped displacement body having a sheet-free base portion, FIG. 3 shows a box-shaped displacement body with gridless end faces, FIG. 4 shows a diagrammatic front view of a displacement body provided with sheet covering on both sides, FIG. 4*a* shows a detail A of FIG. 4, FIG. 5 shows a front view of a further embodiment of a displacement body according to the invention, FIG. 6 shows a top plan view of the displacement body of FIG. 5, FIG. 7 shows a displacement body formed of box-shaped hollow sections, FIG. 8 shows a perspective view of a displacement body with end cover members, FIG. 9 shows a sectional view along the line IX—IX in FIG. 8, FIG. 10 shows an alternative arrangement for attaching the end cover member, FIG. 11 shows a cross-sectional view of a building structure according to the invention with a displacement body in the form of a single hollow section, FIG. 12 shows a cross-sectional view of a structure with a displacement body formed of a plurality of interconnected hollow sections, FIG. 13 shows a cross-sectional view of a structure with a plurality of individual displacement bodies positioned on a plane reinforcement of the structure, FIG. 14 shows a cross-sectional view of a ceiling constructed of the building structures of FIG. 13, FIG. 15 shows a cross-sectional view of a structure including a box-shaped displacement body, FIG. 16 shows a top plan view of a grid structure provided with sheets on both sides prior to being deformed, and FIG. 17 shows a top plan view of a web-shaped grid structure covered with shrinkable sheets on both sides prior to being deformed.

DESCRIPTION OF THE PREFERRED EMBODIMENT

Figure 1:
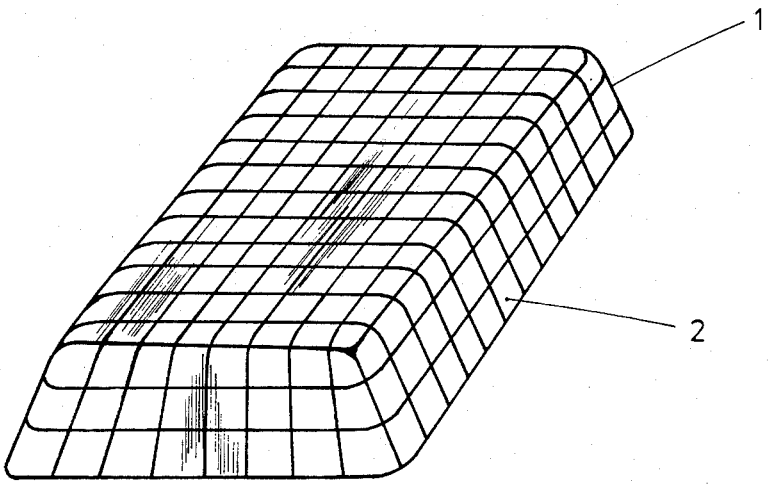

FIG. 1 shows a displacement body in the form of a box-shaped hollow section of trapezoidal shape in longitudinal and cross sections, which may for instance be employed for the construction of ribbed concrete ceilings. The displacement body consists of walls formed of a grid structure 1, the outer surface of which facing towards the concrete to be poured thereon is covered by a flexible sheet 2. Grid structure 1 preferably consists of a suitably formed construction steel mat, the rod thickness and spacing of which may be selected in accordance with stability requirements. The grid structure may be made of other materials, such as of synthetic resins. The flexible sheet 2 is preferably a conventional shrinkable plastic sheet.

Figure 2:
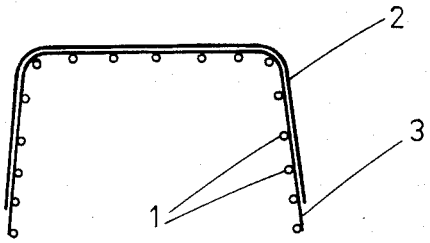

FIG. 2 shows a displacement body according to the invention in the form of a downwards opening channel section with downwards diverging sidewalls the base portions 3 of which are not covered with sheet 2. This sheet-free base portion 3 preferably extends along the entire periphery of the open side of the hollow section. On embedding the displacement body in concrete, sheet-free base portion 3 is completely enclosed in the concrete to result in secure fixation of the displacement body.

Figure 3:
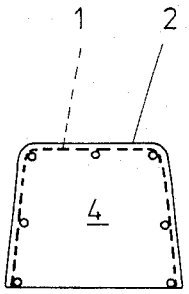

In the case of elongate narrow hollow sections it has been found that the end faces 4 may be formed of the sheet 2 alone without the reinforcing grid structure 1. A displacement body of this type is shown in FIG. 3. This embodiment permits the grid structure 1 to be formed of a construction steel mat without requiring any additional welding operations or connection means along the edges of the end faces 4.

Figure 4A:
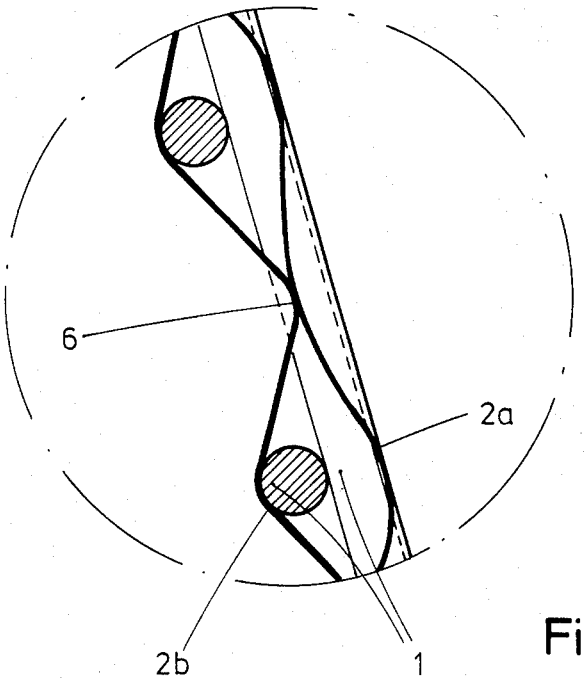
Figure 4:
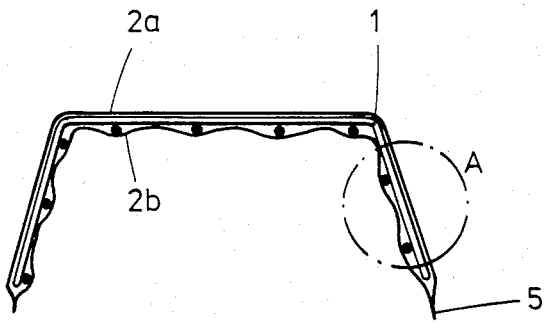

FIG. 4 shows a cross-sectional view of a displacement body in the form of a downwards open channel section for employ as in the construction of ribbed concrete ceilings. The displacement body again consists of a wall formed of grid structure 1 and flexible sheet 2. Grid structure 1 is a suitably deformed construction steel mat. The outer and inner sides of grid structure 1 are both covered by a layer 2*a*, 2*b* of flexible sheet 2. The two plastic sheet layers 2*a*, 2*b* are interconnected by welds 5 at least adjacent the lower longitudinal edges of the channel section. The two sheet layers 2*a*, 2*b* may in addition be interconnected by welding along the transverse edges at the ends of the displacement body.

The enlarged detail A shown in FIG. 4*a* shows the configuration of the flexible sheet layers 2*a*, 2*b* on the finished displacement body. At the locations of the grid openings the two layers 2*a*, 2*b* are additionally interconnected by weld spots or seams 6, which may be formed in all of the grid openings or only in selected ones.

Figure 5:
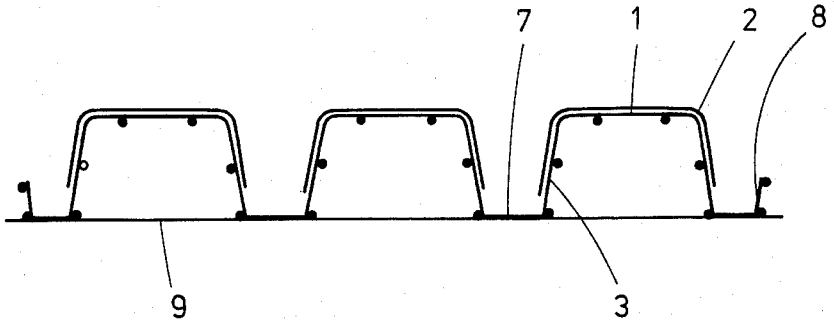
Figure 6:
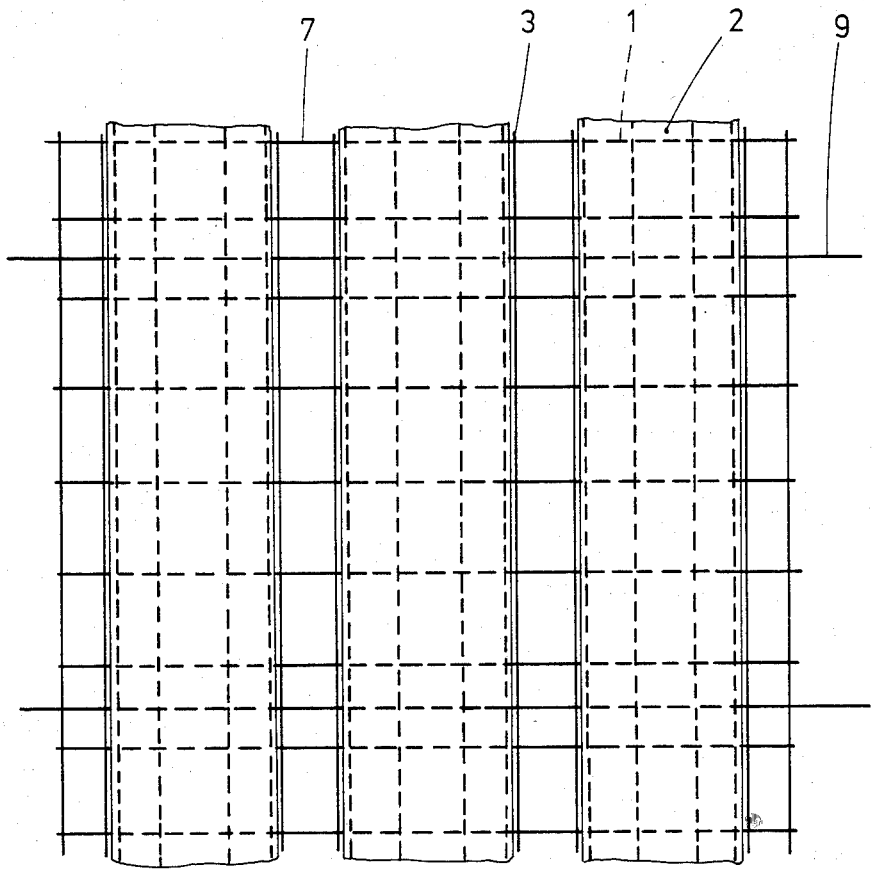

FIGS. 5 and 6 show a displacement body which may be employed for instance for making ribbed concrete elements. The displacement body consists of a plurality of parallel, downwards open channel sections formed of grid structure 1, and covered with flexible sheet 2 in such a manner that a base portion 3 along the lower longitudinal edges of the channel sections remains free. Base portions 3 of adjacent channel sections are connected to one another by connecting webs 7. The longitudinal edge portion 8 of grid structure 1 is bent upwards at substantially right angles. Transversely extending reinforcement struts 9 may be attached to the open underside of the hollow sections. Grid structure 1 of this embodiment is made of a suitably deformed construction steel mat. It may also consist, however, of other materials, e.g. of plastic. Although the connecting webs 7 are shown in the drawing as being rectilinear, they may also be arcuate or angled shape for improving stability of the structure.

Figure 7:
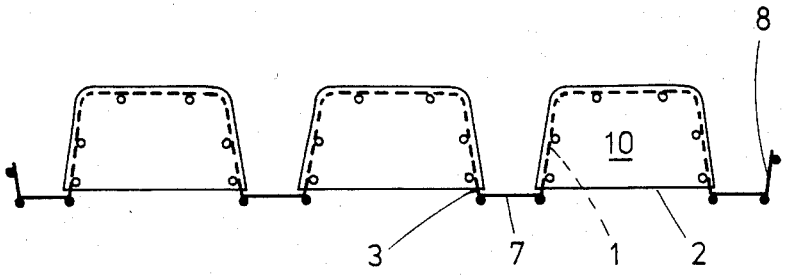

In the case of narrow and elongate hollow sections as shown in FIG. 7 it has been found that the narrow ends 10 thereof may be closed by flexible sheet 2 alone, without the reinforcing grid structure 1.

Figure 8:
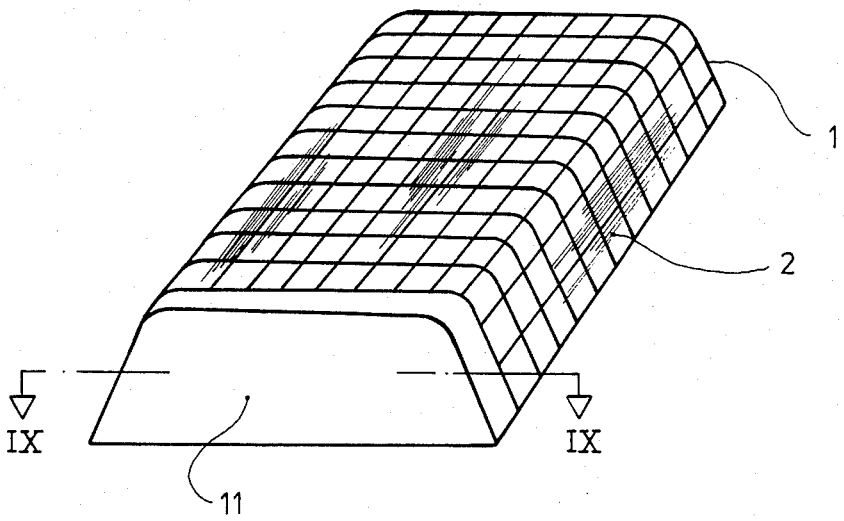

Shown in FIG. 8 is a channel-shaped displacement body the ends of which are open, i.e. not closed by grid structure 1 and/or sheet 2, instead of which they are closed by a plastic closure member 11.

Figure 9:
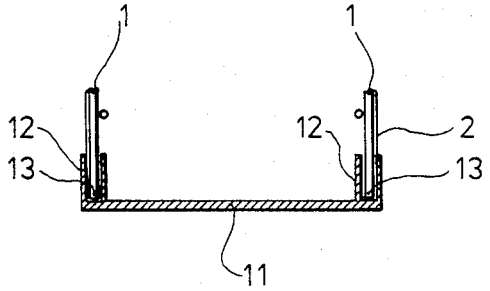

As shown in FIG. 9, closure member 11 is formed with a groove 12 extending along its peripheral edges, the contours of which correspond to those of the channel section. Groove 12 is dimensioned and shaped for receiving the edge 13 of the corresponding end of the channel section in a close press fit.

Figure 10:
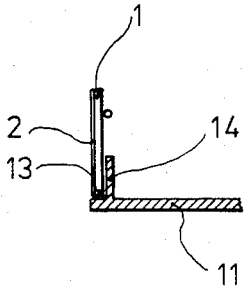

An alternative embodiment of means for attaching end cover member 11 is shown in FIG. 10. Cover member 11 is in this case provided with oppositely located engagement tongues 14 adapted to lockingly engage the inner surfaces of the closed wall portions.

Figure 11:
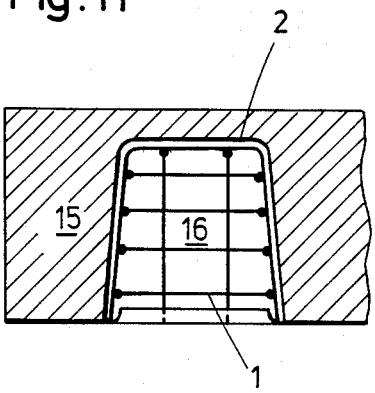

FIG. 11 shows a cross-sectional view of a ribbed structure of concrete 15 with a displacement body in the form of a hollow section 16 as shown in FIG. 1 embedded therein. The displacement body is again formed of a suitably shaped grid structure 1 covered by a tensioned sheet 2. Grid structure 1 consists of a construction steel mat formed to the shape of a hollow section. Sheet 2 is a plastic sheet shrunk onto grid structure 1.

Figure 12:
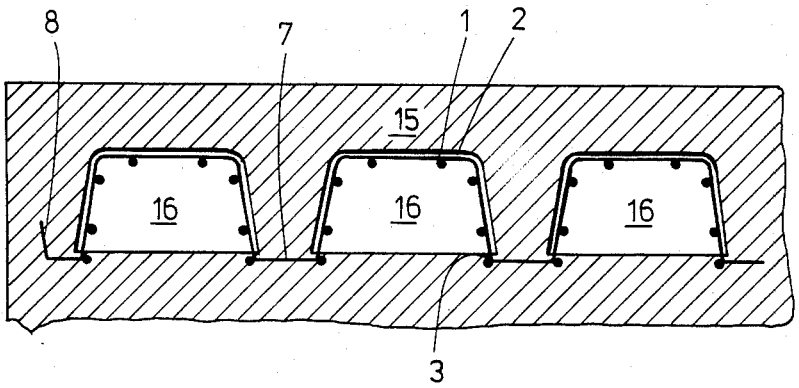

Shown in FIG. 12 is a plate-like structure of concrete 15 formed with a plurality of tunnel-shaped cavities for weight reduction. These cavities are formed by means of a displacement body as shown in FIGS. 5 and 6. The individual hollow sections 16, in the example shown downwards opening channel sections, each have a sheet-free base portion 3 extending over the full length of the lower edges of hollow sections 16. Adjacent hollow sections 16 are interconnected by connecting portions 7.

Web-shaped connecting portions 7 are integrally formed with the grid structure 1 of hollow sections 16. Grid structure 1 is formed with an upstanding end portion 8 not covered by sheet 2 for improved fixation in concrete 15. Transversely extending reinforcement struts (not shown) may be attached to to open lower sides of hollow sections 16 for stabilizing the shape thereof. Web-shaped connecting portions 7 are completely embedded in concrete 15 and may provide sufficient reinforcement for structural members not subjected to excessive loads. Normally, however, reinforcement elements such as grid beams and/or reinforcing steel mats will be embedded in the concrete between the cavities and below, possibly also above the cavities, respectively.

Figure 13:
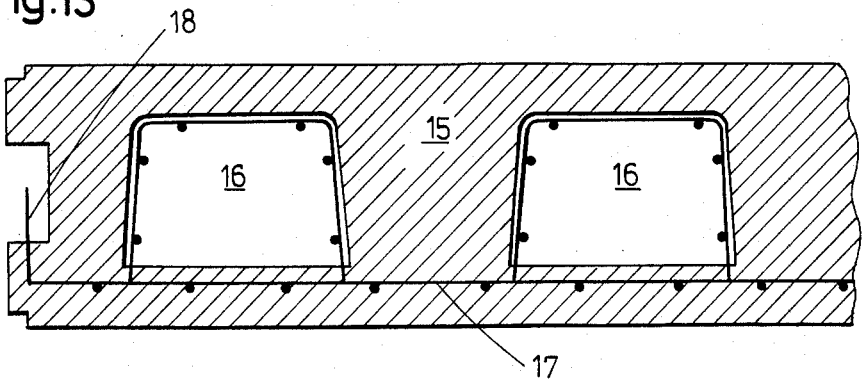

FIG. 13 shows a structural member of concrete 15 provided with a plurality of cavities formed by embedding therein a corresponding number of hollow sections 16 particularly of the type shown in FIG. 2. Hollow sections 16 in this case consist of individual downwards opening channel sections formed of the construction steel grid structure 1 and plastic sheet 2 attached thereto. Sheet-free base portions 3 are seated on a conventional construction steel mat 17. Mat 17 has an upwards bent edge portion 18 extending substantially at right angles thereto into a groove formed along an abutment edge of the structural member.

Figure 14:
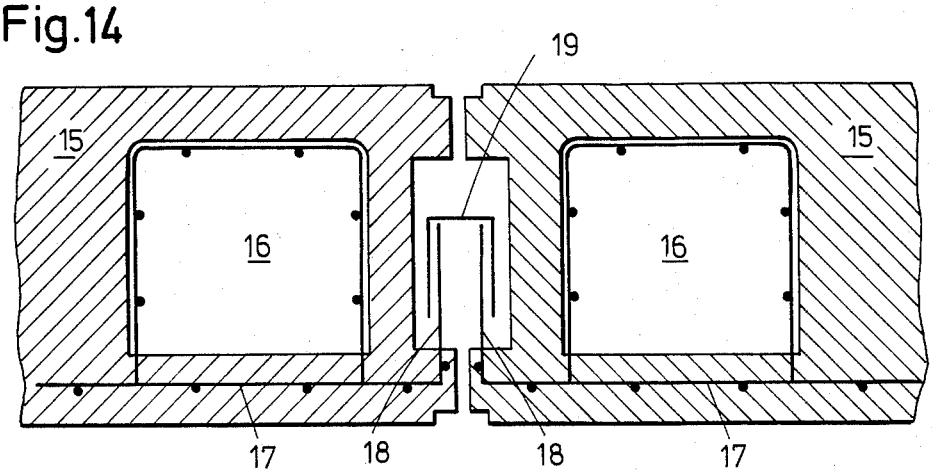

FIG. 14 shows two structural members particularly of the type shown in FIG. 13 in juxtaposed arrangement. The upstanding edge portions 18 of the reinforcing steel mats 17 are bridged by a U-shaped bracket 19 to form a joint reinforcement. The joint groove may subsequently be filled up with concrete.

Figure 15:
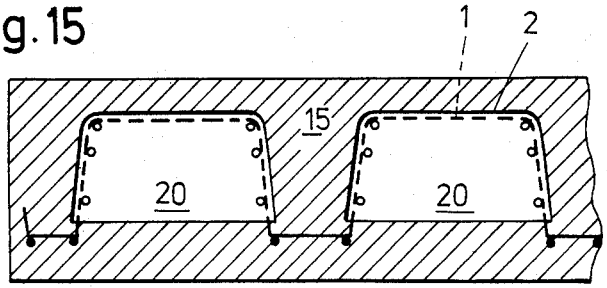

Shown in FIG. 15 is a concrete structure containing a displacement body of the type shown in FIG. 7. The hollow sections of this embodiment are substantially box-shaped with their end faces 20 also enclosed in concrete 15. In the case of narrow and elongate hollow sections of this type it has been found that the walls closing their ends 20 may be formed of sheet 2 alone, without the reinforcing grid structure 1. This permits grid structure 1 to be formed as by pressing or bending of a construction steel mat without any additional welding or connecting operations at the peripheral edges of the ends 20.

It is also possible to omit the sheet 2 altogether, in which case the open ends may be closed with the end closure member 11.

Although for reasons of simplicity the displacement bodies in FIGS. 11 and 12 to 15 have been shown with the sheet applied to only one side thereof, they may of course have covered both of their sides with the sheet material.

If the cavities formed in the concrete are to be filled up at some later time, as in the case of a foundation anchor construction, it is preferred to employ a normally solid, but in case of need readily destructible sheet material, so that there remains no separation layer in the finished concrete structure. Particularly suitable for this purpose are combustible or meltable sheets which may be burned or melted off with a conventional blowtorch after the surrounding concrete layer has been poured.

A structure according to FIG. 11 is made by seating the displacement body on a shuttering and pouring the concrete to the desired thickness.

The structures of FIGS. 12 to 15 are made by initially pouring a concrete layer and inserting the displacement body, with or without a reinforcement mat, into the poured layer up to the lower edge of the sheet material, so that the sheet-free base portions, the connecting webs and/or the reinforcement mat are embedded in the concrete, whereafter a further concrete layer may be poured up to the desired thickness. This method may of course also be employed for forming a single cavity in the concrete structure by using a displacement body in the form of a single hollow section having a sheet-free base portion.

According to a first method, the displacement body of the invention may be made by spreading a sheet 2 on a preshaped hollow section of the grid structure 1 conforming to the shape of the cavity to be formed, and affixing it thereto. This method is particularly suitable if a shrinkable sheet is used, which is to be heat-shrunk on a grid structure consisting of non-bendable material. In this method a tubular sheet may be pulled over the grid structure, or a single-layer sheet may be folded thereover and subsequently fastened to the grid structure by the application of heat, whereby the free edges of the sheet are securely connected to one another and/or to the grid structure 1. This method is also applicable to the construction of at least peripherally closed displacement bodies by pulling a tubular sheet material over the preshaped grid structure and affixing it thereto by heat-shrinking. The resulting displacement body may be used for instance in a structural member for a staircase.

This method may also be employed for making the displacement body of FIG. 3, in which case the grid structure 1 may be formed of a construction steel mat as by pressing or bending, without requiring any welding or connection operations adjacent the peripheries of the end walls.

In a further preferred method for making the displacement body according to the invention, the sheet 2 is spread on the grid structure 1 while still in its flat shape, whereupon the grid structure 1 and the sheet 2 are together formed to the shape of the cavity to be made.

Displacement bodies particularly as shown in FIGS. 5 to 7, 12, and 15 are made by placing sheet sections of a size corresponding to that of the cavities to be formed onto the flat grid structure 1 at suitable spacings, and affixing them thereto as by heat-shrinking, by mechanical means such as staples or binding wire, by welding or glueing. If it is ensured that the sheet is tightly stretched over the grid structure it may be sufficient to affix only its edges in the manner described. Subsequently the grid structure is formed to the desired shape together with the sheet attached thereto, whereupon reinforcement struts 9 may be attached as by welding.

Figure 16:
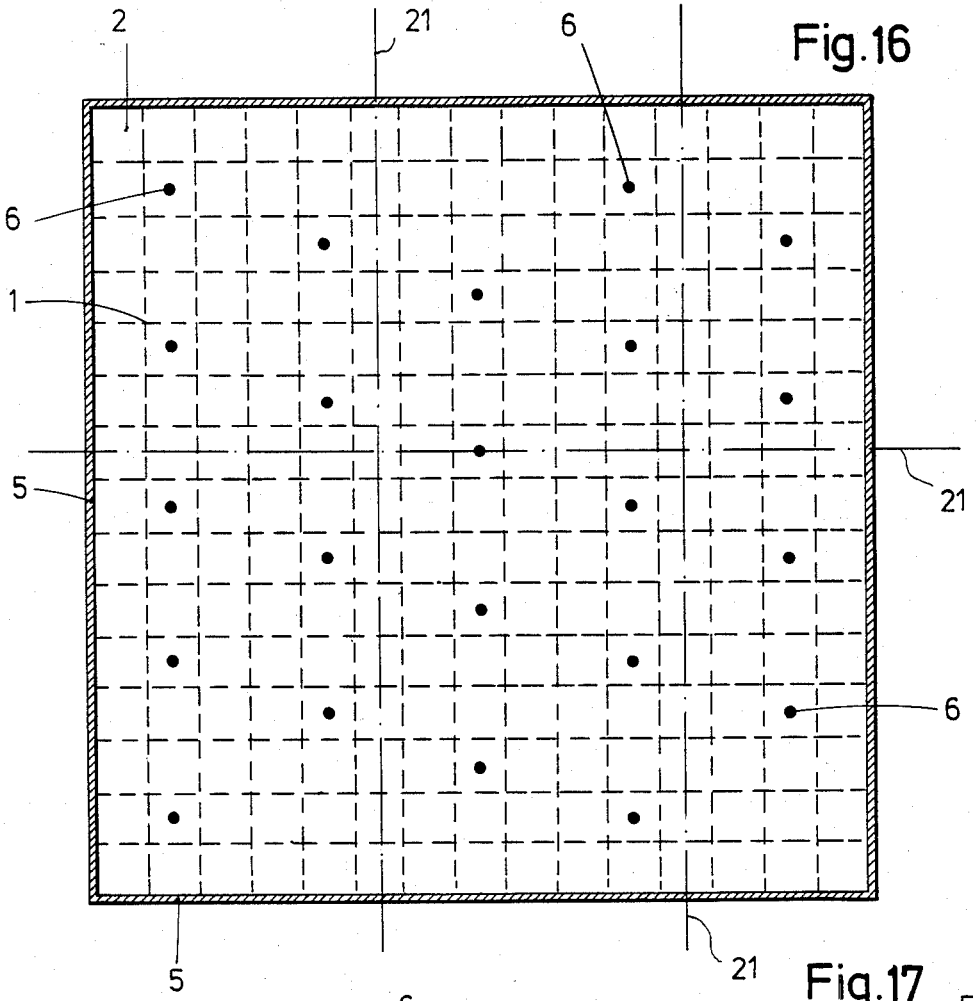
Figure 17:
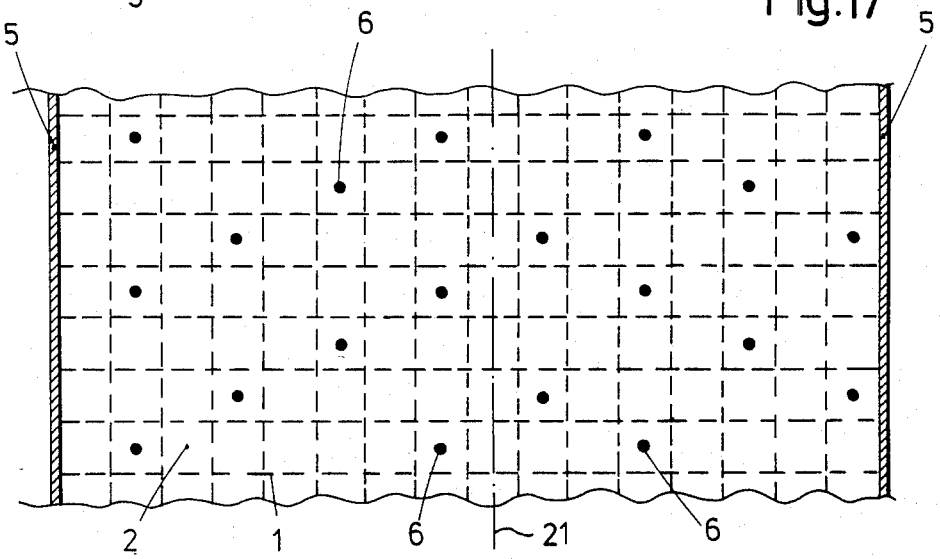

In the case of displacement bodies provided with sheet material on both sides, the production methods according to FIGS. 16 and 17 offer particular advantages. FIG. 16 shows a construction steel mat 1 provided with sheet material 2 on both of its sides prior to being formed to the shape of a displacement body. For making the structure of FIG. 16, plastic sheets *2a, 2b* are spread over each side of the construction steel mat 1. Subsequently the two plastic sheets are welded to one another at least along the later longitudinal edges of the displacement body to be formed, so that the grid structure is enclosed therebetween. At the same time the sheets may be interconnected by welds 6. If the plastic sheet 2 is heat-shrinkable, it is simultaneously or subsequently heated, resulting in the formation of the typical indentations within the areas of the grid openings.

The dimensions of the grid structure 1, to which the sheet 2 is applied in a single operation, may be suitably be dictated by the location of manufacture and available facilities. In a first embodiment of this method, the flexible sheets *2a, 2b* are attached to a grid structure 1 section the dimensions of which are considerably greater than those of the walls of a single displacement body. After the sheets *2a, 2b* have been affixed and connected to one another in the manner described, the finished structure may be cut, for instance along the cutting lines 21 shown in FIG. 16, to individual pieces of the size of a single displacement body. The cutting step is preferably also carried out under application of heat, so that the sheets *2a, 2b* are welded to one another along the cutting lines 21. The individual pieces may then be bent to the desired shape of the displacement bodies. As the cut pieses are easily portable, the bending step may be carried out at the construction site.

In a second embodiment of the method, the sheets *2a, 2b* are applied to a grid structure 1 of a size required for a single displacement body. Particularly suitable for this method is the employ of a tubular sheet material which may be pulled over the grid structure and welded and/or shrunk thereonto. The grid structure may then be formed to the shape of the displacement body together with the sheet material. In a modification of this method for the manufacture of smaller displacement bodies of equal size, a continuous web of the grid structure 1 is enveloped in a tubular sheet material 2 or covered with the two sheets *2a, 2b*. After affixing the sheet material, as by welding, the grid structure may then be cut to individual pieces along the cutting lines 21 (FIG. 17). The invention is of course not restricted to the described embodiments of the displacement body or to the described methods for making same. Thus the individual features described with reference to the figures of the drawings may be readily be interchanged amongst each other.

Further it would be obvious to the skilled artisan that for instance the contours of the hollow sections may be varied as required. If a construction steel mat is employed for the grid structure, the thickness and spacing of the wires or rods may be varied in accordance with strength requirements. For specific uses the grid structure may also consist of other materials, e.g. of plastic. For making particularly light-weight building components, the extremely light-weight displacement bodies of the invention may be employed in combination with a light-weight concrete consisting for instance of a mixture of concrete with expanded plastic flakes or pellets. The sheet-free base portions are only required in such cases, in which the displacement body is to be solidly anchored in the concrete structure. Welding of the two sheet layers within the areas of the grid openings may also be carried out in a different configuration or manner. In the case of a shrinkable sheet material, the welds may be formed by the application of mechanical pressure during the heat-shrinking step. In the case of a plastic sheet material the sheets may also be affixed by other means and methods than the above described heat-shinking method. The sheets may thus by affixed by mechanical means such as conventional staples or binding wire, or may be adhesively attached as by means of conventional adhesives or adhesive tapes. Welding is also possible. In all of these methods, care has merely to be taken that the sheets are tightly stretched over the grid structure. As long as this in ensured it is completely sufficient to affix only the edges of the sheets to the grid structure. The preferred method, however, is fastening by heat-shrinking.

For uses in which the displacement body has to support heavier loads, its walls may be interiorly supported by stiffening brackets. The stiffener brackets are of angular cross-section with the legas thereof formed with means for engaging the lower longitudinal edges of for instance a channel section, while the apex of the angular bracket carries a support plate engaging the upper wall of the channel section. The legs thus serve to maintain the width of the channel section under load, while the support plate prevents sagging of the upper wall.

If a still greater stability is required, the displacement body of the invention may be readily employed in a double- or multiple-decker arrangement without noticeably increasing the weight of the finished structure.

For making particularly thick and at the same time light-weight structures, two or more displacement bodies may be embedded in the concrete above one another to result in rows of cavities disposed above one another.

I claim:

1. A displacement body for forming a cavity in a concrete structure and comprising: at least one hollow section in the shape of said cavity, said hollow section comprising a wall determining the contours of said cavity, characterized in that said wall comprises a grid structure (1) formed of construction steel mat and a flexible plastic shrinkable sheet (*2a*) covering the side of said grid structure facing towards the concrete and attached to said grid structure by being shrunk thereonto so as to close at least some of the grid openings.

2. A displacement body according to claim 1, characterized in that said sheet (2) consists of a readily destroyable combustible material.

3. A displacement body according to claim 1, characterized in that the base portion (3) of a downwardly open hollow section is free of any sheet.

4. A displacement body according to claim 3, characterized in that a plurality of hollow sections for simultaneously forming a plurality of cavities are interconnected by connecting portions (7) formed of said grid structure (1) and free of said sheet.

5. A displacement body according to claim 4, characterized in that for forming a ribbed concrete structure said hollow section are in the shape of parallel channel sections connected to one another by sheet-free webshaped connecting portions.

6. A displacement body according to claim 5, characterized in that said grid structure (1) is formed with substantially vertically upstanding edge portions (8) not covered by said sheet.

7. A displacement body according to claim 1 or 2 or 3 or 4 or 5 or 6, characterized in that two flexible sheets (*2a* and *2b*) are provided, each disposed on one side of said grid structure (1) facing away from the concrete, and in that the sheets (*2a, 2b*) are connected to said grid structure.

8. A concrete structure having a cavity formed by means of a displacement body permanently remaining in said structure, said displacement body comprising at least one hollow section (16) formed of a grid structure (1) and a flexible sheet (*2a*) covering the side of said grid structure facing towards the concrete (15), characterized in that said grid structure (1) comprises a metallic wire grid formed of concrete construction steel mat, and said flexible sheet (*2a*) is a plastic shrinkable sheet (*2a*) attached to said grid structure (1) by being shrunken thereonto so as to cover at least some of the grid openings.

9. A structure according to claim 8, characterized in that said grid structure (1) is provided with a further flexible shrinkable sheet (*2b*) at its side facing away from said concrete, and in that the two sheets (*2a, 2b*) are connected to said grid structure.

10. A structure according to claim 8 or 9, characterized in that in the case of a downwardly open hollow section (16) a base portion (3) thereof is free of any sheet and is embedded in said concrete (15).

11. A structure according to claim 10, characterized in that the sheet-free base portion (3) is connected to a flat reinforcement mat (17).

12. A structure according to claim 11, characterized in that said reinforcement mat (17) is formed with substantially vertically upstanding edge portions (18).

13. A structure according to claim 8 or 9, characterized in that said displacement body consists of a number of hollow sections (16) interconnected by webshaped connecting portions (7) of said grid structure (1), and in that said connecting portions are free of said sheet and embedded in concrete.

14. A structure according to claim 13, characterized in that said grid structure (1) is formed with substantially vertically upstanding edge portions (8) free of any sheet and embedded in concrete.

15. A ceiling formed of structures according to claim 14, characterized in that the upstanding edge portions (8, 18) projecting into a joint between adjacent structures are bridged with a U-shaped bracket (19).

* * * * *